United States Patent [19]

Amann et al.

[11] 4,386,473

[45] Jun. 7, 1983

[54] RECOVERY OF SEDIMENTS FROM THE BOTTOM OF THE SEA

[75] Inventors: Hans Amann; Jürgen Burkhardt, both of Hanover; Klaus Lück, Wennigsen; Fritz O. Poeppel, Wunstorf OT Luthe, all of Fed. Rep. of Germany

[73] Assignee: Preussag Aktiengesellschaft, Fed. Rep. of Germany

[21] Appl. No.: 197,793

[22] Filed: Oct. 17, 1980

[30] Foreign Application Priority Data

Oct. 19, 1979 [DE] Fed. Rep. of Germany ..... 2942304

[51] Int. Cl.[3] ..... E02F 3/88

[52] U.S. Cl. ..... 37/57; 37/58; 37/195; 73/864.41; 73/864.43; 175/5; 175/58

[58] Field of Search ..... 37/195, 54, 58, 57, 37/63, 71; 175/394, 58, 5, 6; 299/8, 9; 73/864.43, 864.41

[56] References Cited

U.S. PATENT DOCUMENTS

| | | | |
|---|---|---|---|
| 526,531 | 9/1894 | Hussey | 37/71 X |
| 618,332 | 1/1899 | Cloudman | 37/54 X |
| 2,308,437 | 1/1943 | Becker | 37/65 |
| 2,643,096 | 6/1953 | Bates | 37/195 X |
| 3,310,952 | 3/1967 | Veder | 37/193 X |
| 3,710,878 | 1/1973 | Endo et al. | 37/195 X |
| 4,076,313 | 2/1978 | Sperandeo | 37/71 X |
| 4,175,342 | 11/1979 | De Koning et al. | 37/72 X |

FOREIGN PATENT DOCUMENTS

| | | | |
|---|---|---|---|
| 659732 | 4/1979 | U.S.S.R. | 175/58 |

*Primary Examiner*—Clifford D. Crowder

*Attorney, Agent, or Firm*—Allegretti, Newitt, Witcoff & McAndrews, Ltd.

[57] ABSTRACT

In a method and apparatus for the recovery of sediments from the sea bottom, a suction head having a mouth is lowered into the sediment, raised from the sediment to form a depression, laterally moved to a new location adjacent the first depression, and the cycle is repeated to form a new depression. The suction head includes loosening means in the form of a worm or flukes which exert a low frictional resistance with respect to the sediment during lowering of the suction head and high frictional resistance when the head is being raised from the sediment.

16 Claims, 4 Drawing Figures

RECOVERY OF SEDIMENTS FROM THE BOTTOM OF THE SEA

BACKGROUND AND SUMMARY OF THE INVENTION

The invention relates to a method for the recovery of sediments from the bottom of the sea by means of a freely suspended suction pipe provided on one end with a suction mouth.

The invention further relates to apparatus for carrying out the method, comprising a floating body from which the suction pipe is suspended which carries at its lower end the suction head having attached thereto loosening means to dislodge the sediment to be recovered.

A prior art conveyor apparatus is known from German patent specification DE-OS No. 2 707 899, which includes a conveyor pipe the lower end of which is movable and in tightly fitting circumferential relationship with a cylindrical structure. Disposed between the cylinder and the end of the conveyor pipe is a drive means to reciprocate the two parts in an opposed motion. This reciprocating motion not only serves to produce a pumping action, but also produces high frequency vibrations. Such vibrations are intended to assist in the penetration of the mud to be conveyed and to prevent the creation of channels therein. This object, however, is achieved only partially achieved in actual practice.

The same disadvantage has been found in the conveyor apparatus according to the earlier German patent specification No. P 28 41 203.5 in which vibrations are generated in a similar fashion as in the afore mentioned well known device to loosen bottom formations. The vibratory movements are performed by a vibratory screen which may be in the shape of a cone pointing downward so that the direction of vibration is vertical. A device of this type is not capable of successfully loosening and dislodging relatively compact formations of mud-like consistency from the sea bottom as they occur, for instance, in the Red Sea at great depths. In any event, a device of this type is not capable of adequately loosening and dislodging sediment at any great depths in the sediment layers, but only near the less compacted surface of the sediment where the material is of a sufficient fluidity.

It is the object of the present invention to provide a method for the recovery of sediments by means of a freely suspended suction pipe by which sediments having the consistency of compacted mud can be recovered.

The object of the present invention is achieved by a method in which the suction means in the form of a suction mouth is successively slowly lowered into the sediment to be recovered, is raised up again to a height at which it is freely laterally movable, is laterally moved a predetermined distance, is lowered again, and so on, in a repeating cycle. The predetermined path of lateral movement is such that a lateral sliding of the suction mouth down into the depression formed in the sediment by the previous work cycle is avoided.

This teaching is based on the experience that vibrators do not produce a sufficiently effective loosening action. Moreover, the loosening effect of the well known prior suction heads provided with vibrators is limited to the area immediately surrounding the screen or to top layers of the sediment which are of a sufficiently low viscosity. Furthermore, the invention takes into account the fact that a lateral feed thrust, for instance in surface regions of the sediment which are of a satisfactory viscosity, will meet with difficulties at greater depths, such as for example 2000 meters. With this in mind, the method of the invention provides for the recovery operation or the forward thrust, respectively, to take place principally in the downward direction, by slowly lowering the suction mouth into the sediment, with the speed being so adjusted that the sediment portions in front of the suction mouth will be dislodged. In view of the high flow speeds in the region of the rims of the suction mouth, a loosening of even relatively compact mud-like formations is possible. Upon completion of the downwardly directed stripping action, which forms a more or less cylindrical to conical depression in the sediment, the method of the invention does not even attempt to continue the recovery operation in a sideways direction. Rather, the suction mouth is raised and is laterally moved a distance such that during the subsequent slow lowering of the suction mouth, any guiding forces in the sediment which may have been generated by the previous work cycle and which would cause the suction mouth to slide down into the previously formed depression, are rendered ineffective. Thus, it is insured that the suction mouth again is able to penetrate vertically into the sediment at the new location adjacent the previously worked depression to, thereby, form a new depression in the sediment to be recovered. In this manner, it is possible to expedite the penetration of the sediment by the suction mouth by using mass forces. By concentrating large masses in the suction head, considerable forces are realized enabling the suction head to penetrate also into relatively solid sediments and to loosen the material.

The lateral movement of the suction mouth attached to the suction pipe, which is freely suspended during the lateral movement, does not require a corresponding movement of the upper end of the suction pipe. Instead, it is sufficient to progressively move the upper end of the suction pipe sideways on the surface of the water, at a speed which corresponds to the mean lateral velocity of the suction mouth. During the lowering of the suction assembly into the sediment, the lower end of the suction pipe is guided in the respective depression so that small lateral forces due to the slightly sloping direction of the suction pipe caused by its steadily being advanced have no effect. When the suction pipe is raised to a height at which it is freely laterally movable, the lower end of the suction pipe having the suction mouth is, likewise, caused to move sideways due to the sloping condition of the suction pipe caused by the progresssive lateral movement, independent of the degree of such slope and the flow resistances prevailing at the suspended suction pipe, so that merely a predetermined period of time needs pass until the next work cycle is initiated, to ensure that the suction head has traversed the required distance. Consequently, notwithstanding the great lengths of the freely hanging suction pipe at a sufficiently controlled lateral movement of the floating body, it is possible to calculate with great precision the spacing of the depressions in the sea bottom sediment. Acoustic positioning means may be used to control the operation.

To assist the suction mouth in the penetration of the sediment, the invention provides for mechanical drilling, stripping or scraping means attached to the suction mouth, which means are rotated during the lowering and/or lifting of the suction mouth. Such rotational movement can be accomplished without difficulty by rotating the entire suspended suction pipe on the surface of the sea so that any special drive means for the suction mouth, as they are for instance required in the prior art vibratory suction heads, can be dispensed with, which represents a considerable advantage when working in great depths and, in addition, at high temperatures as is the case, for example, in the Red Sea.

The invention also provides for apparatus for carrying out the method. Such apparatus comprises a floating body from which the suction pipe is suspended which has attached to its lower end the suction head provided with means for loosening the sediment. In accordance with the invention, such loosening means are so constructed that they exert only a low degree of frictional resistance with respect to the sediment when lowered into it, while they exert a high degree of frictional resistance when they are extricated from the sediment. This particular type of construction takes into consideration the fact that as the suction mouth is penetrating into relatively solid sediment layers, there is danger of lateral deflection or buckling of the suspended suction pipe hitting the formation. For this reason, the frictional resistance is kept low during penetration into the sediment, whereby such deflections are avoided. Conversely, when the suction assembly is lifted, the large loosening forces may come into their own without disadvantage.

Loosening means which have the mentioned properties may be of a variety of types. They may for instance comprise a worm which is freely rotatably mounted at the lower end of the suction pipe and, as it is being lowered, drills into the sediment, while during the lifting stroke, forces are operative which prevent a rotation of the worm. Consequently, the sediment in the area surrounding the suction head is dislodged or loosened in large scale like fragments. However, the worm may also be fixedly mounted on the suction pipe, and the desired rotation of it may be brought about by a corresponding rotation of the upper end of the suction pipe on the surface of the sea.

Another form of construction that the loosening means may take is that of a folding anchor which will open up during lifting so that the surrounding sediment will be gripped and pulled up in large scales.

As the suction head and loosening tool assembly is being raised, generating a great amount of frictional resistance in accordance with the invention, an area of reduced pressure is produced below the loosening tools. This feature is utilized by a further development of the invention, in that the suction head is provided below the loosening means having high frictional resistance values, e.g. flukes or pivot plates, with nozzles pointing downwardly or preferably sideways. Such nozzles are in communication by way of a channel with entry openings which are located at a sufficient height above the means having large frictional resistance values, e.g. the flukes or pivot plates. The reduced pressure thus generated has the effect that water is caused to rush into this area, precipitating a flushing and loosening process which continues during the entire extent of the upward movement.

The sediment in its upper layers frequently has a viscosity which is amenable to pumping. Moreover, during working the sediment, a cloud of whirling sediment particles is produced immediately above the sediment surface. To aid in the flushing process going on in the region below the loosening means and to augment its effect, water is used by suction action from the mentioned cloud of sediment particles or from fluid layers of sediment. Arranging the suction openings at fixed locations on the suction pipe may entail the probability that they are too high up, resulting in the undesirable admission by suction of sediment-free water.

To remedy this situation, according to a further embodiment of the invention, the entry openings are spread out over an extended vertical stretch of the suction pipe. A vertically movable cover pipe is arranged over the suction pipe to cover this spread. The cover pipe is provided with means for its height adjustment. This height adjustment may be effected in the simplest case by a rope hanging from a spot above the surface of the sea. It is preferred, however, to have such height adjustment means comprise floating bodies, whereby the total buouancy of the cover pipe and floating bodies is so adjusted that the cover pipe is maintained floating in a fluid layer of predetermined density. This type of assembly is capable of accommodating varying heights as, for example, in the case of a funnel-shaped depression the depth of which is slowly increasing while the level of essentially sediment-free water is decreasing.

Another form of the means for height adjustment of the cover pipe consists of supporting surface areas for engagement by the side edges or rims of the hole or funnel formed in the sediment. As the funnel-shaped depression in the sediment is widened and deepened, the supporting surface areas will follow the changing configuration and, thus, effect a lowering of the height of the cover pipe.

BRIEF DESCRIPTION OF THE DRAWINGS

Further objects and features of the invention will be described with reference to an illustrative embodiment as shown in the accompanying drawings, in which.

DESCRIPTION OF THE PREFERRED EMBODIMENTS

Figure 1:
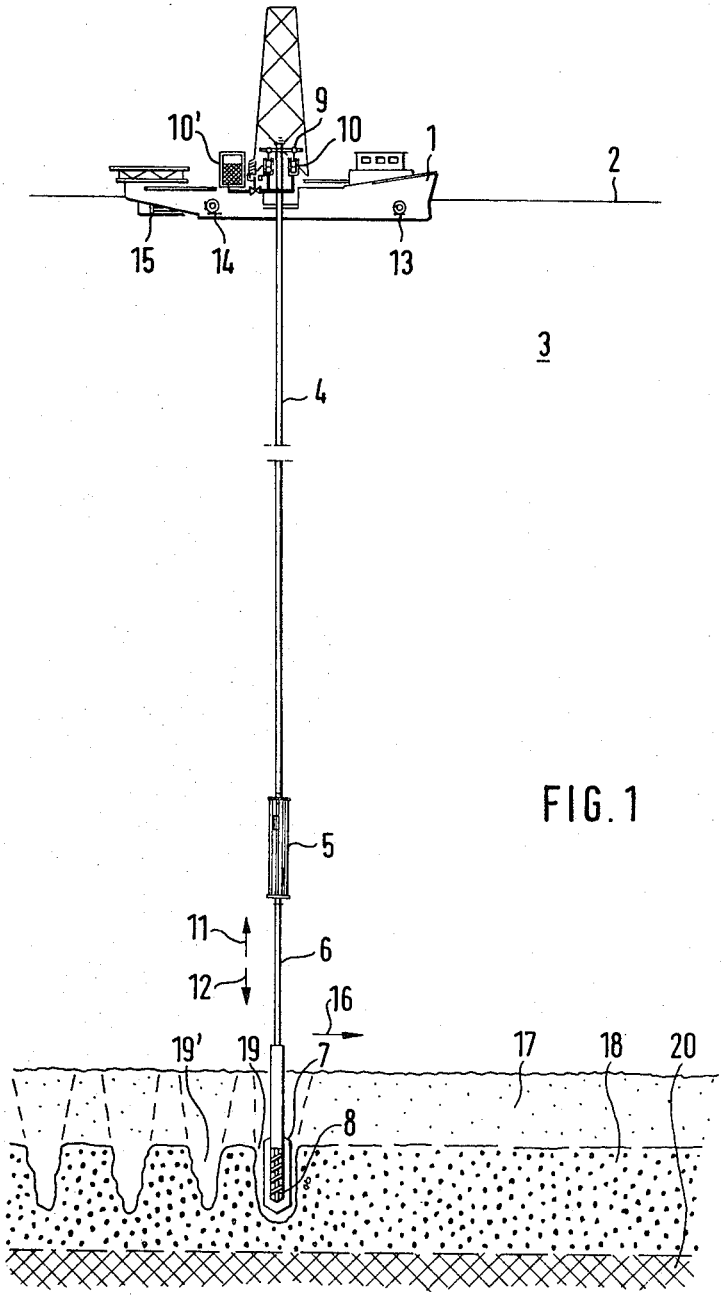
FIG. 1 is a schematic representation of the principles underlying the method of the invention.

In the largely schematic illustration of FIG. 1, a ship 1 is positioned on the surface 2 of a body of sea water 3. Extending downwardly from the ship 1 is a conveyor pipe 4, the lower section of which has mounted thereon a pump 5 from which a suction pipe 6 leads to a suction head 7 provided with a suction mouth 8. The suction head is illustrated in greater detail in FIGS. 2 and 3.

The conveyor pipe 4 is suspended from the ship 1 by means of a suspension structure 9. The suspension structure 9 is supported on two hydraulic cylinders 10 which move the conveyor pipe 4 and the members attached thereto, in particular the suction head 7, up and down as indicated by the arrows 11 and 12. The hydraulic cylinders 10 are biased by a gas pressure storage container 10'.

Located in the bow of the ship 1 is a drive means which together with the drive means 14 in the ship's stern serve to maintain the ship in directional alignment with respect to the vertical axis. Further provided in the rear of the ship is a screw propeller 15 by which the ship is slowly and steadily advanced in the direction of the arrow 16.

In employing the method according to the invention, the hydraulic cylinders 10 are so actuated in the direction of the arrow 12 that the suction head 7 is caused to be lowered into a sediment composed of two layers 17 and 18. The layer 17 has a viscosity such that the suction head 7 is freely laterally movable therein. The more compact layer 18 is penetrated by the suction head 7 owing to the weight of the suction head 7 to form a depression 19 in the shape of an ordinary hole or a funnel, depending on the nature of the sediment. The depth of the depression 19 may extend approximately to the region of the lower boundary of the layer 18, subject to the prevailing forces and the nature of the layer 18. Disposed below the layer 18 is a geological formation that does not warrant recovery.

The cylinders 10 are then actuated in a manner as to cause the conveyor pipe 4 having the suction head 7 fastened thereon to be lifted again. Both during the lowering and, particularly, the lifting operation, the conveyor pump 5 becomes effective to enable the suction head to convey by suction volumes of sediment of mud-like consistency from the depression 19. Depressions 19' produced in previous operations are indicated to the left of the depression 19 in FIG. 1.

When the suction head 7 on the upstroke reaches the layer 17 in which it is freely laterally movable in the direction of the arrow 16, the suction head 7 will be moved a distance in the direction of the arrow 16 such as to ensure that at the next downward stroke a new depression 19 is formed. The spacing between two depressions will be seen from a comparison of the depressions 19 and 19'.

The lateral movement of the suction head 7 is effected by a progressive movement of the ship 1 by means of its screw propeller 15, with the result that the conveyor pipe 4 will hang slightly tilted, not shown in the drawing, so that the suction head 7 has a tendency to drift sideways in the direction of the arrow 16. On reaching the layer 17 during the upward movement, the suction head 7 may tend to follow this pull and move off in the direction of the arrow 16, in dependence upon the magnitude of the lateral sag and the flow resistance of the other members immersed in water. However, at a constant movement of the ship 1 and by properly controlling the hydraulic cylinders 10 from the completion of the upward stroke to the renewed lowering of the suction assembly, it is only necessary to wait a predetermined period of time to ensure that the suction head has moved a predetermined distance in the desired direction as indicated by the arrow 16. The setting of the constant speed of the ship 1, the lateral sag of the conveyor pipe 4 and the time interval between the completion of the lifting and the resumption of the lowering action may be determined in accordance with tests performed on the material recovered, or by performing ultrasonic measurements of the respective positions of the suction head 7.

Figure 2:
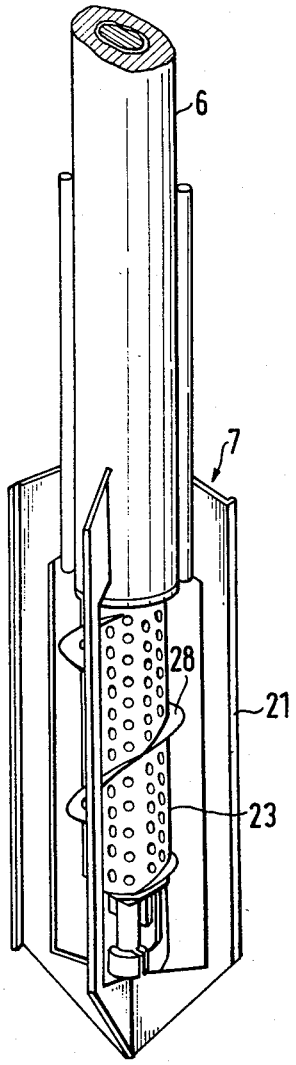
FIG. 2 is a perspective view of the suction head of the invention.
Figure 3:
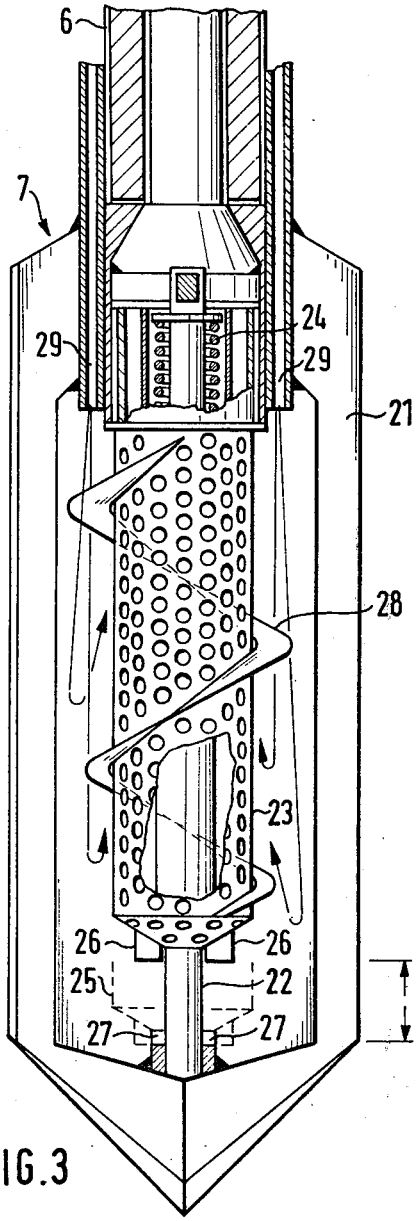
FIG. 3 is a side elevational view, partly in section, and enlarged, of a suction head provided with a worm for use in accordance with the method of the invention.

The suction head 7, which is shown in a perspective view in FIG. 2 and in an elevational side view, partly in section, in FIG. 3, comprises vertically extending guide plates 21 which are secured to the lower end of the suction pipe 6. The free space defined by the guide plates 21 holds a vertically disposed rod 22 which serves as a pivot bearing for a cylindrical screen 23. The screen 23 is also vertically movable on the rod 22 and is downwardly biased by a spring 24 such that, without exerting any force, it may assume a position as indicated by the broken line 25. In this position, projections 26 provided on the screen 23 will be in engagement with stationary recesses 27 to secure the cylindrical screen 23 against rotary movement.

Disposed on the cylindrical screen 23 is a worm 28 extending laterally beyond the projections of the suction pipe 6. The worm 28 is adapted to drill into a mud-like sediment, as the suction head is lowered, by rotating about the shaft 22 in a position indicated by full lines in FIG. 3, i.e. with the spring 24 compressed and the projections 26 released from the recesses 27. When the suction head 7 is raised again, the screen 23 on the rod 22 moves downward so that the projections 26 again will engage the recesses 27 to lock the worm in position against rotary motion. In this position the worm represents a major force of frictional resistance by which the surrounding sediment is disloged, thrust upwardly and loosened so that recovery by suction can take place. The suction action is further enhanced by the action of the flushing nozzles 29.

Figure 4:
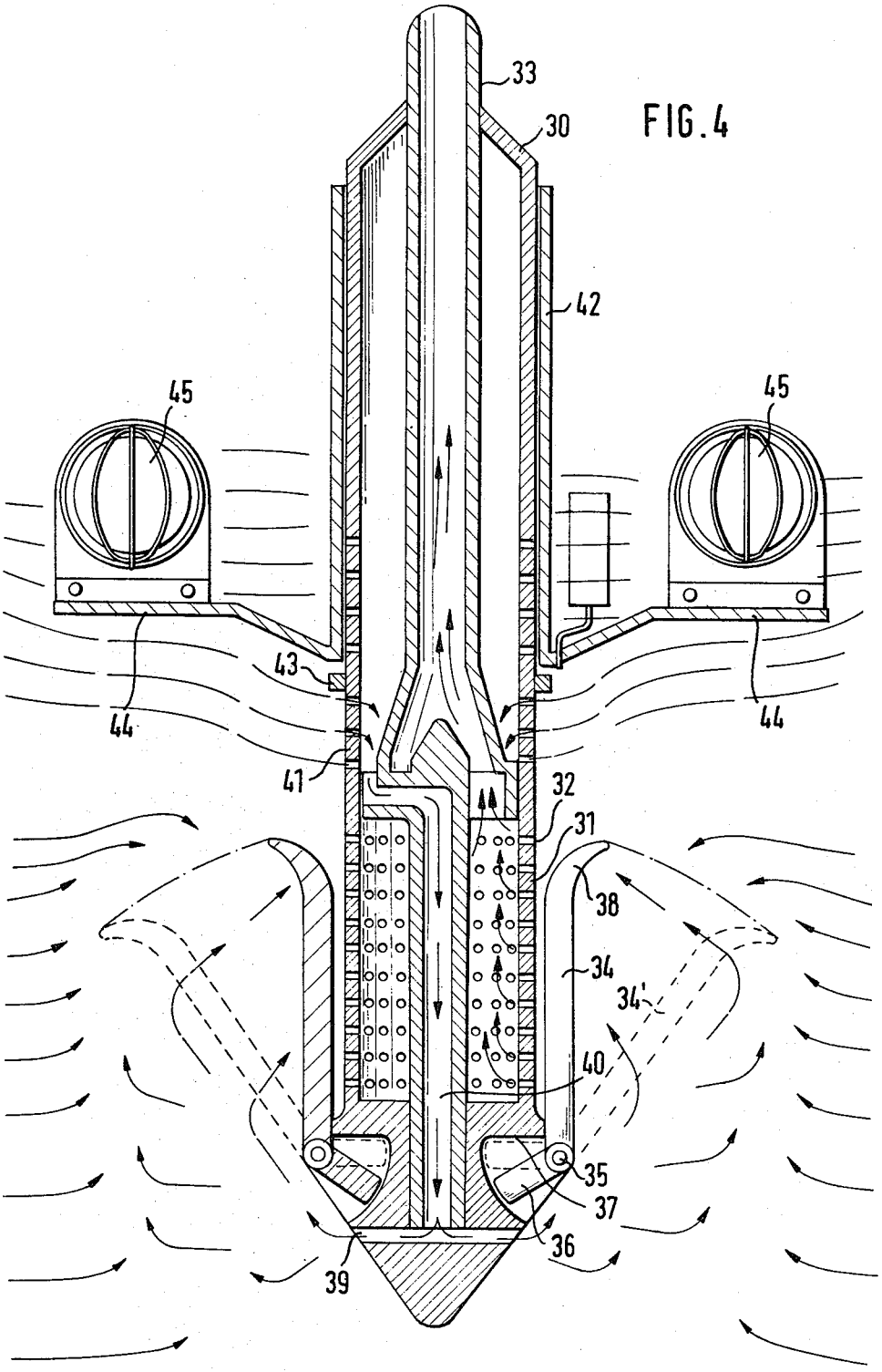
FIG. 4 is a sectional view of a folding anchor type suction head provided with flushing nozzles and means for the height adjustment of suction openings.

FIG. 4 illustrates another embodiment of a suction head which is in the nature of a folding anchor. A shank or pipe 30 closed on top (not shown) constitutes at its lower end 31 a suction mouth provided with a multiplicity of small suction openings which are in communication with a suction pipe 33. The lower end of the pipe 30 is provided with flukes 34 pivotable about pins 35 so as to be pivoted from the folded rest position, as indicated in full lines, into an operative position indicated by dashed lines 34'. In the operative position, the flukes 34 are secured against excessive pivotal movement by extensions 36 which abut against stops 37.

The flukes are provided with outwardly bent end sections 38 to enable the flukes to pivot outwardly as the device is pulled up, thereby producing a great amount of frictional resistance by which the surrounding sediment is dislodged and loosened.

Disposed below the flukes 34, 34' are nozzles 39 which are in communication by a channel 40 with entry openings 41. The openings 41 are arranged above the level of the flukes 34. The entry openings are spread out over a considerable vertical stretch on the pipe 30, which however, is not particularly shown in the drawing for simplicity's sake. This is also true of the distance of the entry openings 41 above the flukes 34. In actual practice, this distance may amount to many meters, depending on the prevailing density or viscosity gradients in the sediment layers 17 and 18 in FIG. 1.

A tubular vertically movable cover pipe structure 42 is provided to cover part of the entry openings 41 on the pipe 30. The drawing shows the lowest position of the cover pipe 42 in relation to the pipe 30, with the cover pipe 42 resting on ledges 43.

The cover pipe 42 is further provided with a plate 44 having buoyancy means 45 thereon, for example in the form of glass spheres. The buoyancy capacity is so dimensioned that, as a function thereof, the assembly consisting of the cover pipe 42, the plate 44 and the buoyancy body 45 is maintained floating at a certain height in the surrounding medium of defined density so that the entry openings 41 are covered. With decreasing density of the surrounding medium, such as water, for example, the cover pipe 42 will be moved downward to cover the corresponding entry openings 41 to prevent the entrance of sediment-free seawater.

It will be understood that the embodiments of the present invention which have been described are merely illustrative of a few applications of the principles of the invention. Numerous modifications may be made by those skilled in the art without departing from the true spirit and scope of the invention.

What is claimed is:

1. A method for the recovery of sediments from the bottom of the sea by means of a freely suspended suction pipe having an upper end and a lower end with a suction head having a suction mouth, comprising the steps of:

slowly lowering the suction head into the sediment to be recovered, and drawing sediment into the mouth by means of suction, thereby forming a depression in the sediment, said depression having an upper edge, vertically raising the suction head above the upper edge of the depression to a height at which the suction head is freely laterally movable, laterally moving the suction head by progressively moving sideways the upper end of said suction pipe on the surface of the sea at a speed corresponding to the mean lateral speed of said suction head over a predetermined distance to a new location away from the formed depression to avoid sliding of the suction head into the depression previously formed in the sediment, and lowering the suction head into the sediment at the new location and successively repeating the cycle.

2. In the method of claim 1, wherein the vertical movements of the lower end of the suction pipe are effected in relation to movement of the upper end of the suction pipe.

3. In the method of claim 1, wherein the suction head having the suction mouth is provided with mechanical stripping means which is rotated during at least one of the lowering and raising steps.

4. In the method of claim 1, wherein the vertical movement of the suction head is effected by correspondingly moving the upper end of said suction pipe.

5. Apparatus for the recovery of sediments from the bottom of the sea comprising, in combination: a floating body, a suction pipe suspended from the body and having a lower end provided with a suction head, said head including movable sediment loosening means attached to the suction head for dislodging the sediment, means for lowering the suction head into and raising the suction head from the sediment, said loosening means comprising members extending outwardly from the suction head and freely movable during lowering by penetration forces and not freely movable during raising so as to exert a low frictional resistance with respect to the sediment during lowering and penetration into the sediment, and a high frictional resistance relative to the sediment when being raised from the sediment, said members comprise a worm, said worm being freely and passively rotatably mounted on the lower end of said suction pipe, said worm having a pitch such that the worm is capable of drilling into the sediment and rotating in response to forces of the sediment acting thereon, and detent means on said worm for preventing rotation of the worm as it is being raised from said sediment.

6. The apparatus of claim 5, wherein said worm is fixedly connected to said suction pipe, and the floating body is provided with means for rotating the suction pipe while it is being lowered into the sediment.

7. The apparatus of claim 5, wherein said suction head includes a cylindrical screen, and said loosening means comprises a worm on said screen.

8. The apparatus of claim 7, wherein said worm is fixedly connected to said screen and said screen is fixedly connected to said suction pipe, and means on the floating body for rotating said suction pipe while it is being lowered into the sediment.

9. The apparatus of claim 7, wherein said worm is fixedly connected to said cylindrical screen, means for mounting said screen for rotation, and detent means for preventing rotation of said screen during the raising of the suction head.

10. The apparatus of claim 5, including vertically operating hydraulic means for maintaining said suction pipe in a vertically movable position, gas pressure storage container means for compensating the weight of said suction pipe and said suction head, and drive means to effect upward and downward motion of said suction pipe.

11. Apparatus for the recovery of sediments from the bottom of the sea comprising, in combination: a floating body, a suction pipe suspended from the body and having a lower end provided with a suction head, said head including a cylindrical screen and movable sediment loosening means attached to the suction head for dislodging the sediment, means for lowering the suction head into and raising the suction head from the sediment, said loosening means comprising a worm on said cylindrical screen extending outwardly from the suction head and freely movable during lowering by penetration forces and not freely movable during raising so as to exert a low frictional resistance with respect to the sediment during lowering and pentration into the sediment, and a high, frictional resistance relative to the sediment when being raised from the sediment, said worm being fixedly connected to said cylindrical screen, means for mounting said screen for rotation, and detent means for preventing rotation of said screen during the raising of the suction head, said cylindrical screen being vertically movable relative to said suction head and is provided at its lower end with projections defining said detent means, oppositely located recesses on a nonrotatable portion of said suction head for receiving said projections during raising of the suction head and lowering of the cylindrical screen relative to said suction head.

12. Apparatus for the recovery of sediments from the bottom of the sea comprising, in combination: a floating body, a suction pipe suspended from the body and having a lower end provided with a suction head, said head including movable sediment loosening means attached to the suction head for dislodging the sediment, means for lowering the suction head into and raising the suction head from the sediment, said loosening means comprising members extending outwardly from the suction head and movable about the vertical axis of the suction head so as to exert a low frictional resistance with respect to the sediment during lowering and penetration into the sediment, and a high frictional resistance relative to the sediment when being raised from the sediment, said members comprising flukes, said flukes being mounted on said suction head so that said flukes fold up during lowering into the sediment and exert little frictional resistance thereby, and spread apart during raising from the sediment.

13. The apparatus of claim 12, wherein said suction head includes laterally outwardly directed nozzles below said flukes, and channel means connecting said nozzles with entry openings positioned in said head above said flukes.

14. The apparatus of claim 13, wherein said entry openings are spread vertically on said suction head, said entry openings having vertically movable cover means arranged thereon, said cover means including means for adjusting its height.

15. The apparatus of claim 14, wherein said cover means includes floatation means, the total buoyancy of said cover means and said floatation means being such that said cover means is maintained floating in a fluid layer of predetermined density.

16. The apparatus of claim 14, including support means for engaging the edges of the depression formed in the sediment.

* * * * *